US005769098A

United States Patent [19]

McDonough et al.

[11] Patent Number: 5,769,098

[45] Date of Patent: Jun. 23, 1998

[54] LIGHTER WITH LOOPED GUARD

[75] Inventors: James M. McDonough, Guilford, Conn.; Gerald J. Doiron, Athol, Mass.; Paul H. Adams, Monroe, Conn.; Floyd B. Fairbanks, Naugatuck, Conn.; Arthur R. Hamilton, Jr., Derby, Conn.; Guy LaForest, Cascais, Portugal

[73] Assignee: BIC Corporation, Milford, Conn.

[21] Appl. No.: 486,855

[22] Filed: Jun. 7, 1995

Related U.S. Application Data

[63] Continuation-in-part of Ser. No. 97,685, Jul. 28, 1993, Pat. No. 5,483,978.

[51] Int. Cl.[6] ..... A24F 13/00

[52] U.S. Cl. ..... 131/329; 431/267

[58] Field of Search ..... 131/329; 431/267, 431/129, 153

[56] References Cited

U.S. PATENT DOCUMENTS 5,483,978 1/1996 Doiron ..... 131/329

*Primary Examiner*—Aaron J. Lewis
*Assistant Examiner*—Charles W. Anderson
*Attorney, Agent, or Firm*—Pennie & Edmonds LLP

[57] ABSTRACT

The lighter of the present invention provides a resiliently deformable guard that covers a portion of the striking wheel assembly. To operate the lighter, a user exerts sufficient pressure to displace the guard before rotating the striking wheel assembly. The configuration of the guard with respect to other elements of the lighter and/or one or more retention means of the guard increases the retention of the guard. Further, the lighter of the present invention may provide a brake member to prevent the rotation of the striking wheel assembly when the user attempts to release fuel or rotate the striking wheel assembly before or without displacement of the guard.

22 Claims, 16 Drawing Sheets

LIGHTER WITH LOOPED GUARD

CROSS-REFERENCE TO RELATED APPLICATION

The present application is a continuation-in-part of co-pending U.S. application Ser. No. 08/097,685 filed on Jul. 28, 1993 now U.S. Pat. No. 5,483,978.

FIELD OF THE INVENTION

The invention relates to a lighter having a guard device incorporated into the lighter. Such devices help to resist undesired use of the lighter by young children.

BACKGROUND OF THE INVENTION

Recently, attention has been directed toward preventing ready actuation of lighters by persons normally not able to appreciate the potential danger of the flame. Such danger includes the potential to burn the individual directly or to burn surrounding areas or items. Individuals normally contemplated in these efforts are young children in the age category of under five years of age.

A conventional lighter includes a body containing a fuel reservoir filled with a liquified and pressurized hydrocarbon fuel, a valve actuator lever, a striker wheel, a flint in frictional contact with the striker wheel, a fuel flow control valve in fluid communication with the fuel reservoir. After the striker wheel is rotated against the flint by digital manipulation to produce sparks, the valve actuator lever is depressed allowing gaseous hydrocarbon fuel to flow out of the reservoir through the flow control valve. The sparks then ignite the released fuel producing a flame. Such lighters are known in the art, and are commercially available.

It is desirable to increase the difficulty of use to limit the ability of young children under five years of age to operate such lighters. For this reason there are many proposed "child-resistant" lighters offered in the patent literature and on the market. Examples of such patents include U.S. Pat. No. 5,125,829; U.S. Pat. No. 5,002,482; U.S. Pat. No. 5,165,886; U.S. Pat. No. 5,090,893; and PCT Application No. WO 93/17282. Each of the disclosed devices has in common the fact that the child-resistant feature somehow acts to block movement of the gas fuel release mechanism to prevent operation of the lighter.

Although many of the currently available designs provide a degree of "child resistancy", there is a continuing search in the art for designs which are more user friendly for the intended adult to operate, while retaining their "child resistancy".

SUMMARY OF THE INVENTION

Accordingly, it is an object of the invention to provide a lighter which is operable by an adult, but resistant to operation by young children.

It is a further object of the invention to provide such lighter that can be manufactured with minimal design modifications.

It is another object of the invention to provide a child-resistant feature for such a lighter that is retained so as to resist removal by the normal user.

These and other objects are achieved according to the present invention by a lighter that requires at least a threshold amount of digital pressure, i.e., pressure exerted by a finger or thumb, be applied on a guard looped at least partially around the striking wheel before the striking wheel assembly can be rotated against the flint to create sparks. Further, the present invention may include brake means to prevent the striking wheel assembly from rotating after the valve actuator is depressed.

These features are provided by a lighter comprising a body defining a fuel reservoir and a cylindrical cavity, and a striking wheel assembly rotatably mounted on the body at a top end, wherein the striking wheel assembly comprises a rotary sparker and at least one turning wheel mounted coaxially with the rotary sparker. The lighter further comprises a flint disposed within the cylindrical cavity and biased into frictional contact with the rotary sparker, wherein rotation of the rotary sparker against the flint creates sparks, and a valve for regulated release of fuel from the fuel reservoir to outside the body of the lighter, wherein the valve has an open position and a closed position. The lighter further comprises a valve actuator pivotally attached to the body, wherein the actuator cooperates with the valve to move the valve between the open position and closed position, and a windshield.

The lighter of the present invention further comprises a guard disposed around the rotary sparker and preferably elevated above or outward from the at least one turning wheel, wherein the guard is depressed to a level where the at least one turning wheel can be manipulated. Additionally, the guard has a spark orifice or other passageway disposed between the fuel valve and the striking wheel assembly to allow the spark to pass therethrough and to reach the fuel valve. Additionally, the guard may further comprise at least one brake member, preferably disposed on the inside surface of the guard, to resist rotation of the rotary sparker unless the guard is properly manipulated.

One or more additional or alternative braking members may be defined on the valve actuator of the lighter. Preferably, the one or more braking members of the valve actuator have a plurality of teeth on one side, wherein after the valve actuator is depressed and the valve is moved to the open position, the teeth of the one or more brake members arrest the rotation of the striking wheel assembly.

Thus, a lighter having the above described guard features and braking members should provide a young child with sufficient deterrent features as to prevent the child from readily producing a flame, or to deter the child from readily producing a flame at least for a time sufficient to permit the normally expected adult intervention.

DETAILED DESCRIPTION OF THE PREFERRED EMBODIMENTS

Figure 1:
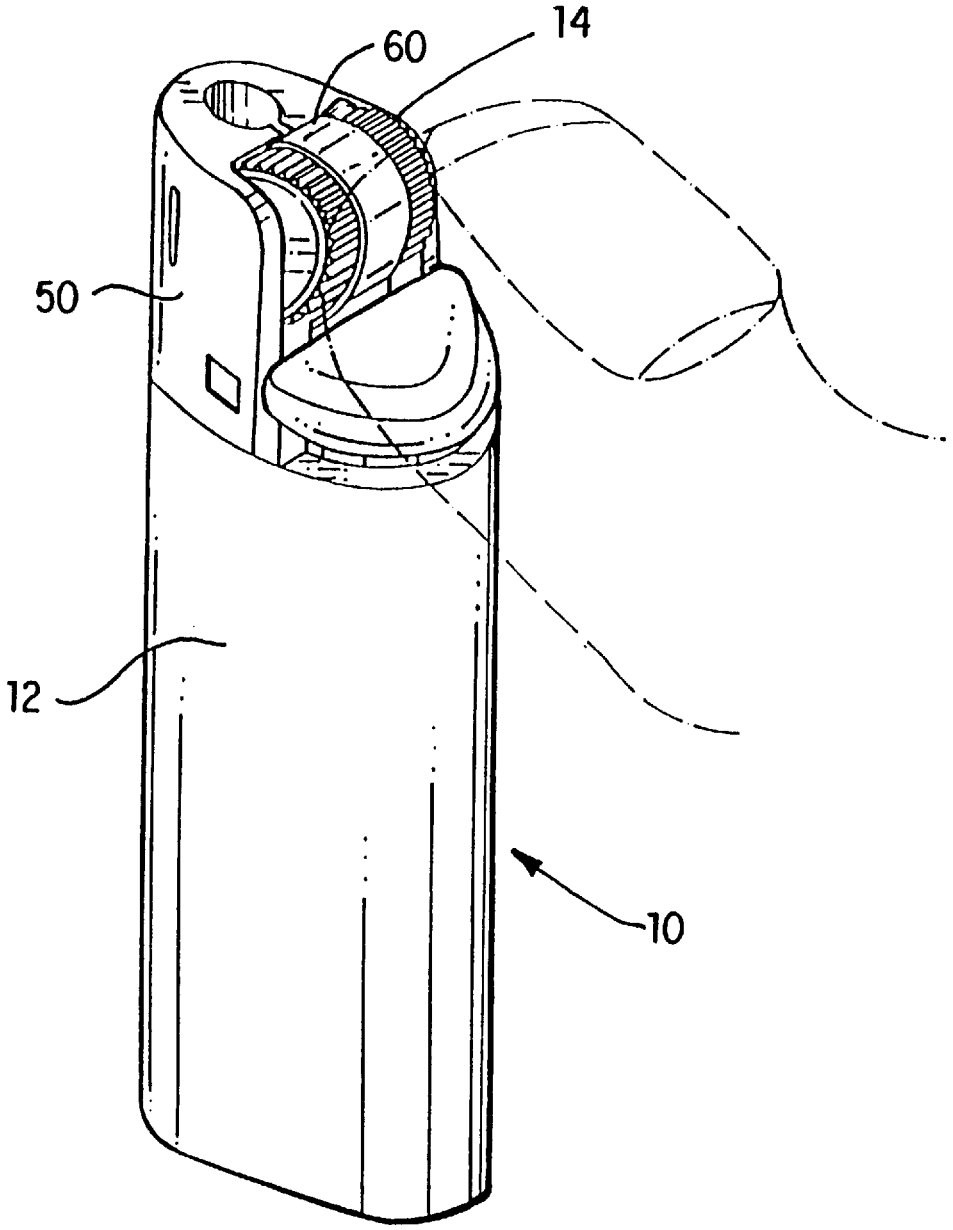
FIG. 1 is a perspective view of a lighter of the present invention.

Referring to the drawings, wherein like reference numbers are used to designate like parts and as shown in FIG. 1, lighter 10 according to the present invention is shown having a guard 60 disposed above and around striking wheel assembly 14. The lighter also includes windshield 50, mounted on top of body 12 and around the fuel release valve as is known in the art.

Figure 2:
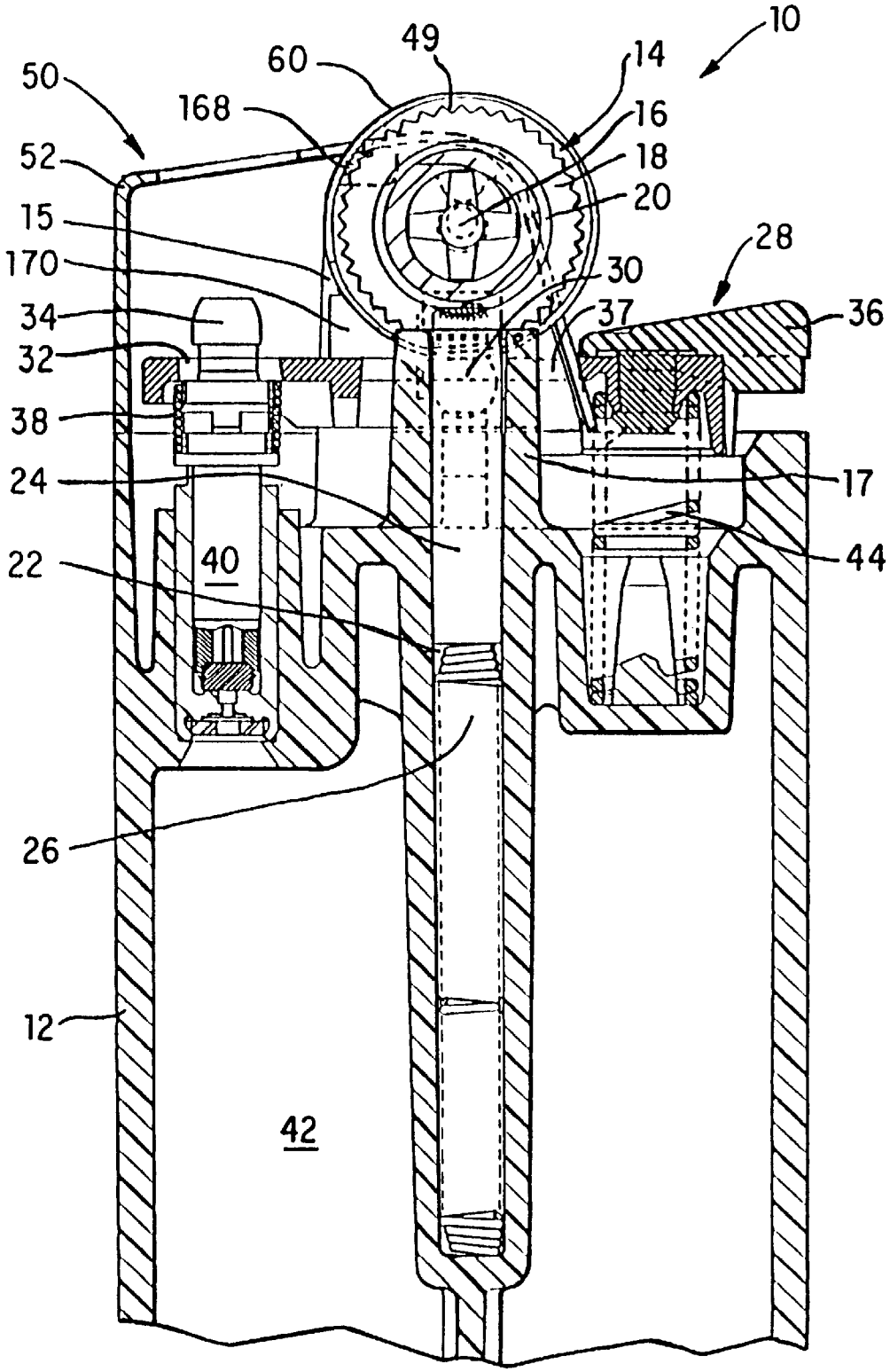
FIG. 2 is a cross-sectional side view of one embodiment of a lighter of the present invention.
Figure 3:
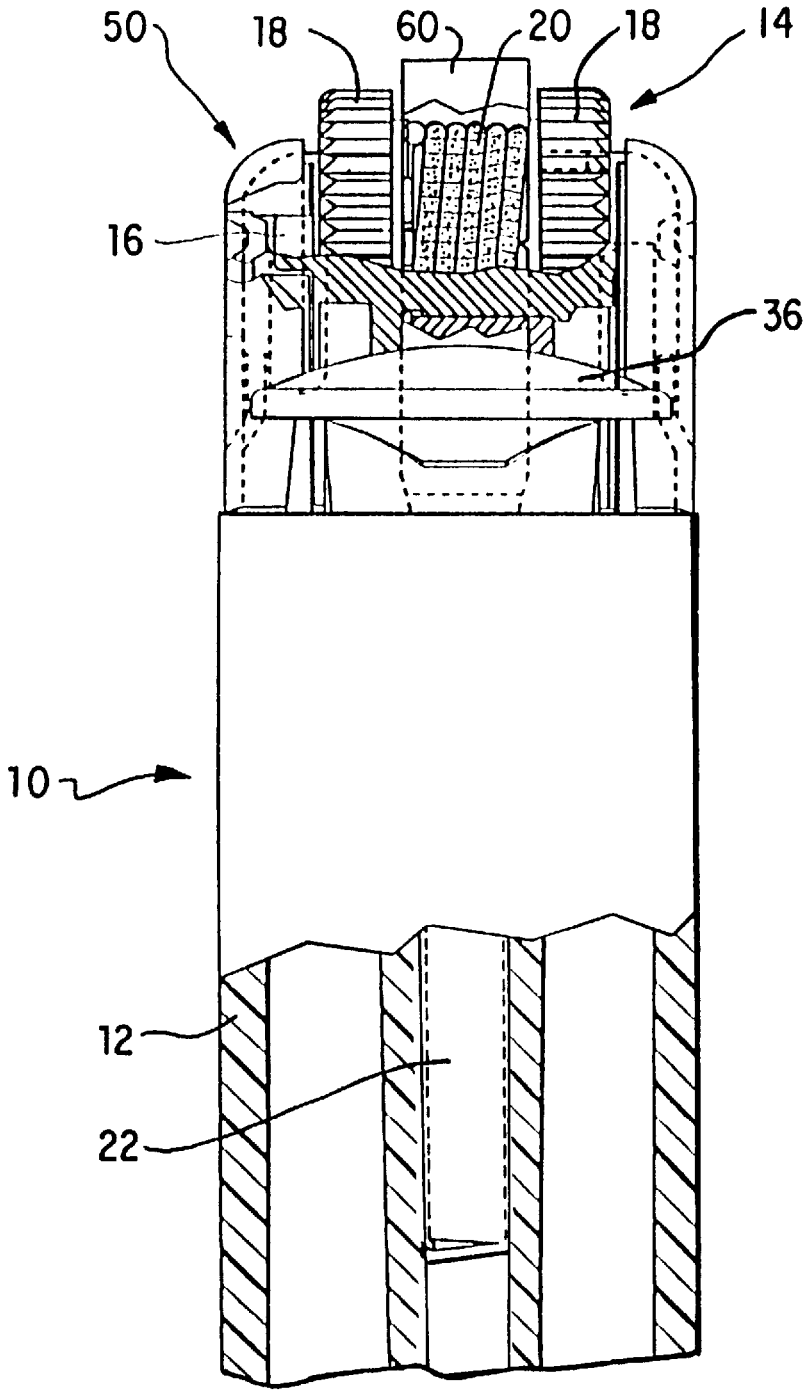
FIG. 3 is a partial cross-sectional rear view of the lighter of the present invention.
Figure 4:
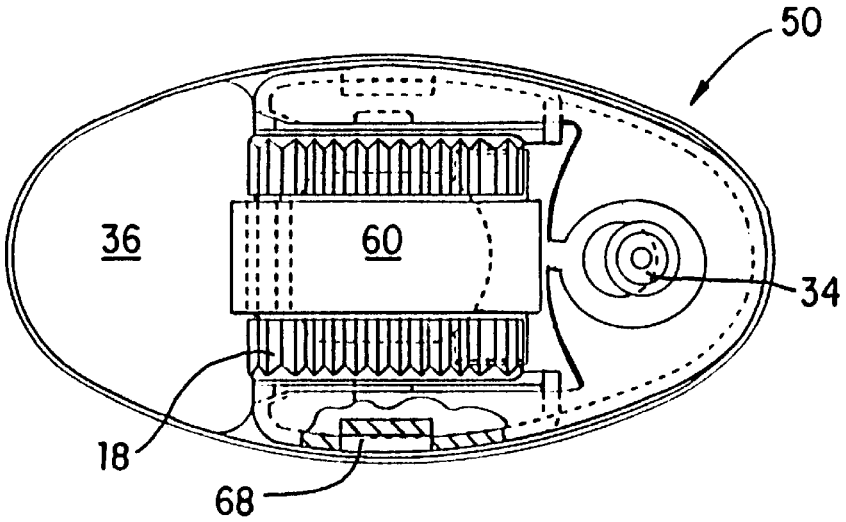
FIG. 4 is a top view of the lighter of the present invention.

More particularly shown in FIGS. 2 and 3, lighter 10 has body 12 with striking wheel assembly 14 rotatably disposed between sparkwheel supports 15 via axle 16. Striking wheel assembly 14 is located at the top end of body 12 and comprises turning wheels 18 preferably disposed on each side of rotary sparker 20. Turning wheels 18 and sparker 20 are connected to one another, and are mounted coaxially on axle 16. Body 12 defines a cylindrical cavity 22 positioned longitudinally and centrally within body 12. Flint 24 is disposed within cavity 22, and is urged into frictional contact with rotary sparker 20 by spring 26.

Figure 5:
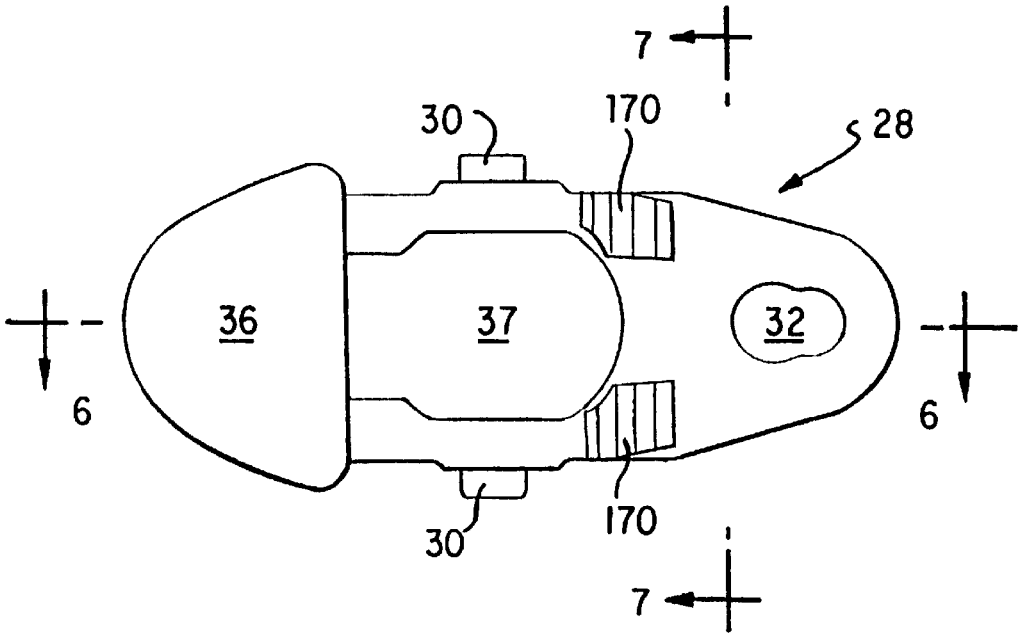
FIG. 5 is a top plan view of a valve actuator of the present invention.
Figure 6:
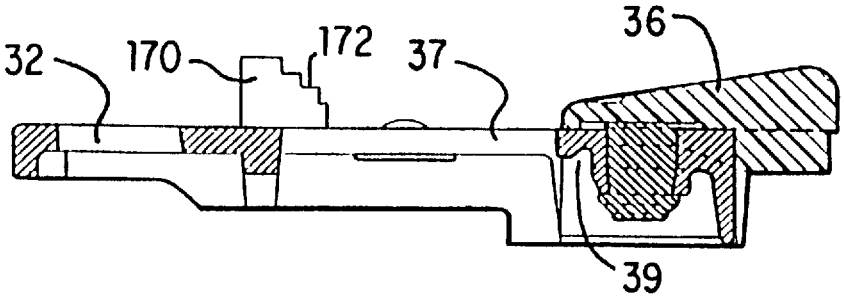
FIG. 6 is a cross-sectional view of a valve actuator of the present invention along line 6—6 in FIG. 5.
Figure 7:
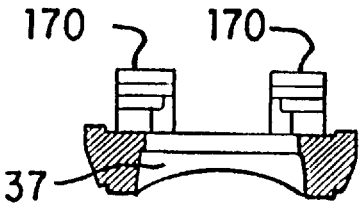
FIG. 7 is a cross-sectional view of a valve actuator of the present invention along line 7—7 in FIG. 5.

Lighter 10 further comprises a valve actuator 28, which is pivotally mounted on body 12 through tabs 30, which are located below axle 16. As shown in FIGS. 5–7, valve actuator 28 defines slot 32 at one end (which may be closed or open). At the other end of the valve actuator 28 is thumb pad 36. In its middle region, valve actuator 28 defines an opening 37, which allows flint 24 to extend from lighter body 12 through valve actuator 28 to contact rotary sparker 20.

Valve 40 controls the release of fuel from reservoir 42. In a preferred embodiment, valve 40 is a normally open valve, forced open by the pressure of fuel within reservoir 42. In this embodiment, as shown in FIG. 2, valve actuator 28 acts on valve 40 to maintain it in a closed position. Compression spring 44 pushes up on a first end of valve actuator 28, forcing the second, opposite end to act downwardly on valve 40 where it extends through slot 32. This pressure maintains the valve in a closed position until thumb pad 36 is sufficiently depressed allowing nozzle 34 of valve 40 to be lifted and thereby releasing the fuel. If desired, second compression spring 38 can be included to act between the valve actuator and valve stem to delay release of fuel before the thumb pad is depressed to a predetermined position. It is contemplated that other suitable valve configurations may be selected by persons of ordinary skill in the art. For example, a normally closed valve, which is forced open by the lifting of the second end of the valve actuator due to depression of the thumb pad may be utilized. Also, second spring 38 may be omitted. The principal purpose of second spring 38 is to delay release of fuel due to tolerances in the mechanism or slight depression of the valve actuator. However, because the guard of the present invention is intended to inhibit the creation of sparks to ignite the fuel, such a feature may be omitted.

Figure 9:
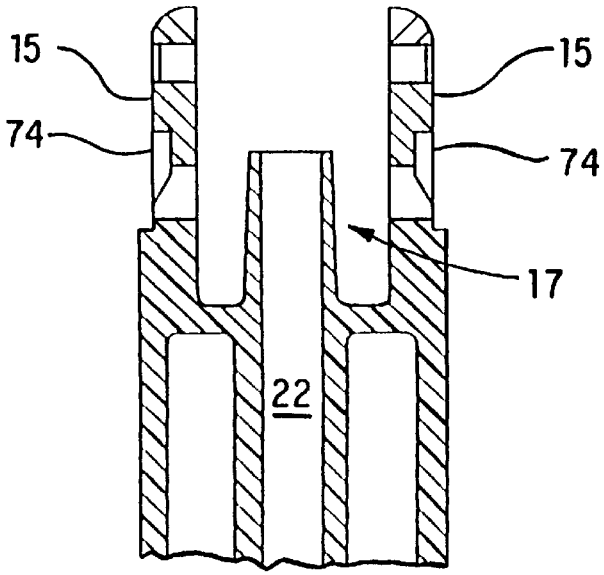
FIG. 9 is a cross-sectional view of the body of the lighter of the present invention along line 9—9 in FIG. 8.
Figure 10:
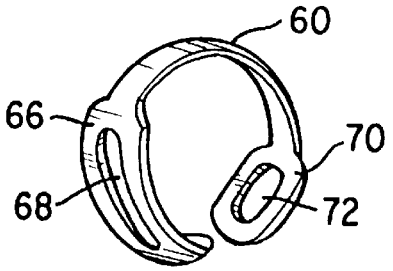
FIG. 10 is a perspective view of a guard of the present invention as shown in FIG. 2.
Figure 11:
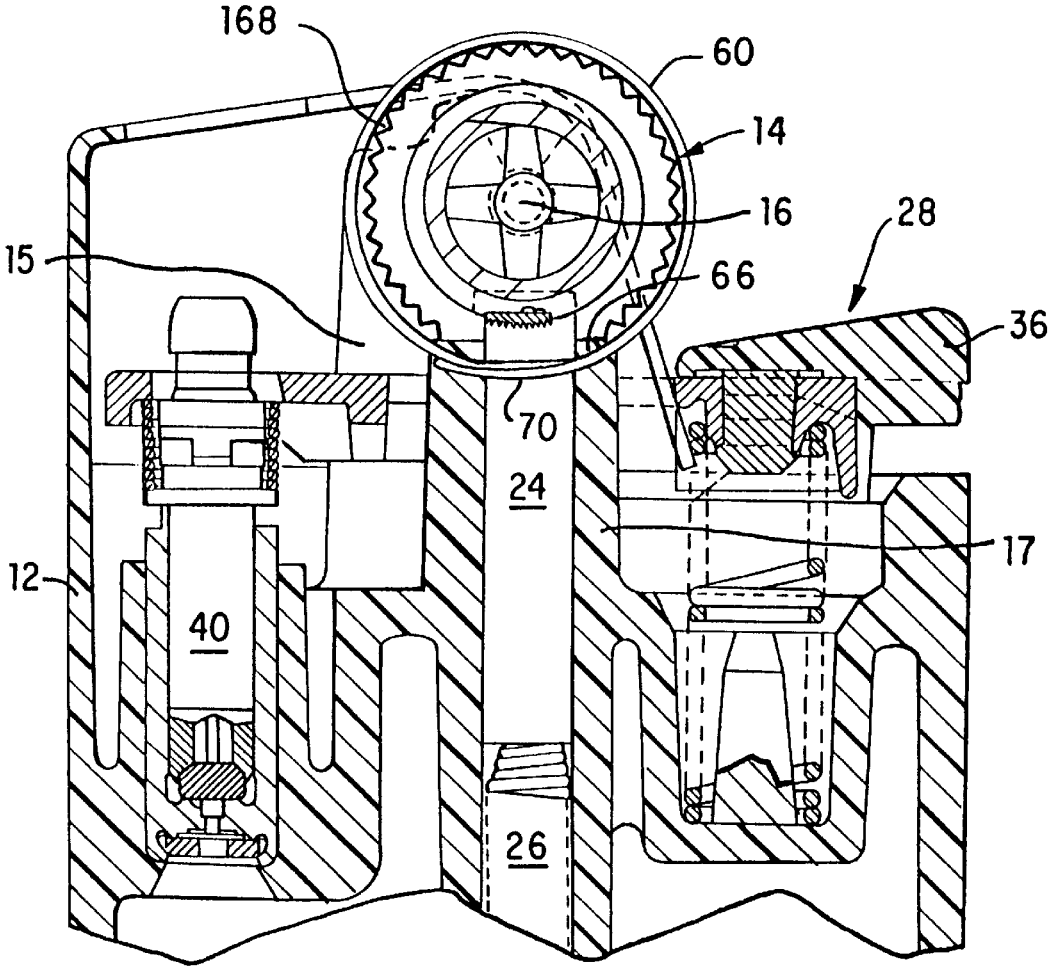
FIG. 11 is a partial cross-sectional side view of the lighter with the guard as shown in FIGS. 2 and 10.

Guard 60, shown in FIG. 10, is disposed around striking wheel assembly 14, as shown in FIGS. 2 and 11. Guard 60 has first end 66 with spark orifice 68 wherein the spark orifice is disposed between striking wheel assembly 14 and fuel valve 40 to permit passage of sparks from the flint to the released fuel. Also, a portion of raised boss 17 of lighter body 12 (more particularly shown in FIG. 9) passes through at least a portion of orifice 68. Guard 60 further comprises second end 70 with opening 72 disposed around boss 17 such that spark orifice 68 and opening 72 overlap at least partially such that guard 60 forms a closed loop, as shown in FIG. 11.

As shown in FIGS. 2, 3, 4 and 11, at least the portion of guard 60 extending from top of shield 50 over the top of striking wheel assembly 14 to the top of thumb pad 36 is shaped and dimensioned to fit over the rotary sparker 20, and positioned radially beyond and above the turning wheels 18. However, the width of at least said portion of guard 60 is such that it extends between but preferably not over turning wheels 18. Guard 60 is preferably elevated above the surfaces of the turning wheels 18, such that guard 60 should be depressed before turning wheels 18 can be rotated.

As stated above, to produce a flame, the user depresses guard 60. Responding to the exerted pressure on guard 60, the guard is deformed, thereby producing an elastic deflection. After the applied pressure is relieved, guard 60 will resume its former shape and position. Alternatively, the guard may be configured and dimensioned such that depression is not required, instead, the size and pulp portion of an adult user's finger are sufficient to manipulate the spark wheels without depressing the guard.

To operate the lighter of the present invention the user asserts a sufficient pressure greater than a predetermined pressure necessary to deform guard 60, such that guard 60 at least partially moves to a position closer to the turning wheels 18, or to a position between the turning wheels 18, to permit the user's finger to engage the wheels for rotation.

Alternatively, it is not necessary to deform guard 60. If guard 60 is positioned such that the fleshy, pulp portion of the adult user's finger is sufficient to extend over and around guard portion 60, the adult's finger can contact turning wheels 18 for rotation without such deformation. Preferably, rotation of the turning wheels would be a result of a combination of both types of action, i.e., the deformation of the guard and the extension of the adult finger partially around the guard. It has been found that a guard made of a grade of steel that when hardened by heat treatment or other method would provide spring like properties is preferable. The guard may have thickness preferably under about 0.050 inches. As will be appreciated by persons of ordinary skill in the art, other materials, hardnesses and thicknesses may be used. Based on the teachings of the present invention as set forth herein, a person of ordinary skill in the art could adapt the present invention as desired.

Figure 18:
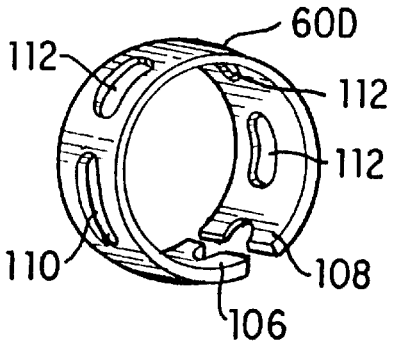
FIG. 18 is a perspective view of another embodiment of a guard of the present invention.

Rotation of the turning wheels 18 causes a spark to be produced in a conventional manner. After the spark is produced by rotation of the turning wheels 18, the user's finger depresses the thumb pad 36 on the valve actuator 28 to actuate a release of fuel from the valve 40. This action occurs after the creation of the spark, as shown in FIG. 18. When rotated with sufficient force by an adult user, the spark created is large enough to ignite the fuel even though it is normally not released until a period of time after the creation of the spark.

The lighter as described above, is child resistant because generally children under five years of age do not have sufficient coordination, digit size or strength to operate the present invention as described.

Figure 8:
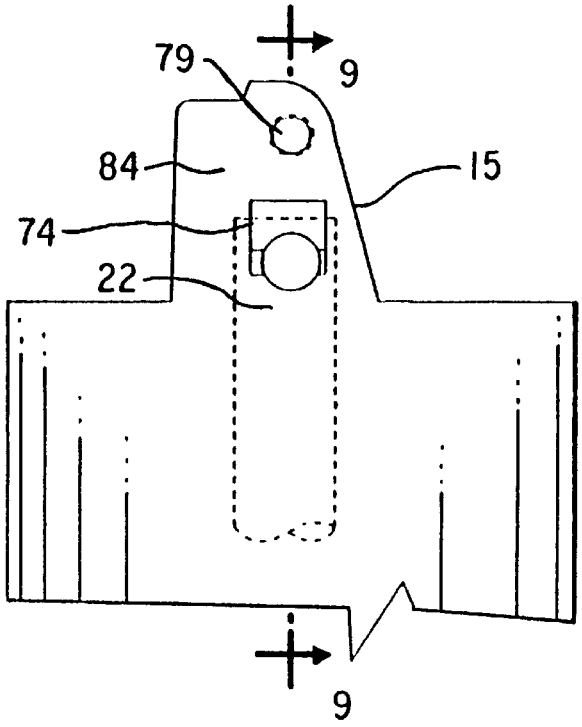
FIG. 8 is a partial side view of the body of the lighter of the present invention.

Because guard 60 forms part of the resistancy of the lighter, it is advantageous to resist or make more difficult the removal of guard 60. The configuration of guard 60 of the present invention therefore makes the removal of guard 60 more difficult. In the first embodiment of the present invention (shown in FIG. 2, 10, and 11), first end 66 and second end 70 of guard 60 disposed around boss 17 retains guard 60 in a closed loop. Guard 60 is further mounted to lighter body 12 by being disposed around striking wheel assembly 14 which in turn is mounted by being disposed between spark wheel supports 15 (FIGS. 8 and 9) via axle 16.

Figure 12:
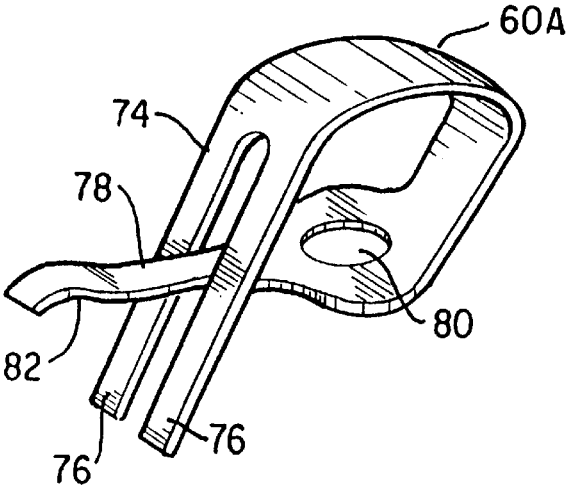
FIG. 12 is a perspective view of another embodiment of a guard of the present invention.
Figure 13:
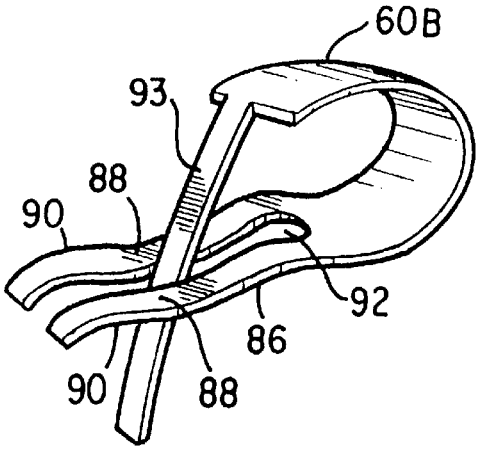
FIG. 13 is a perspective view of another embodiment of a guard of the present invention.
Figure 15:
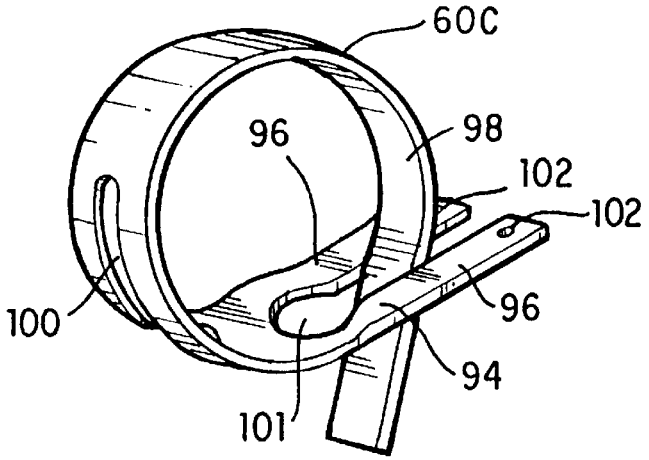
FIG. 15 is a perspective view of another embodiment of a guard of the present invention.

Alternatively, first end and second end of guard 60 may also extend beyond the closed loop. Examples of such guards are shown in FIGS. 12, 13, and 15, which show perspective views of arcuate guards comprising a first end with one or more prongs at a predetermined distance apart. Such guards further comprise a second end with one prong whose width, at least where first end and second end intersect, is equal to or less than the predetermined distance between the two prongs of first end. In addition, second end is disposed between the two prongs of first end.

Figure 14:
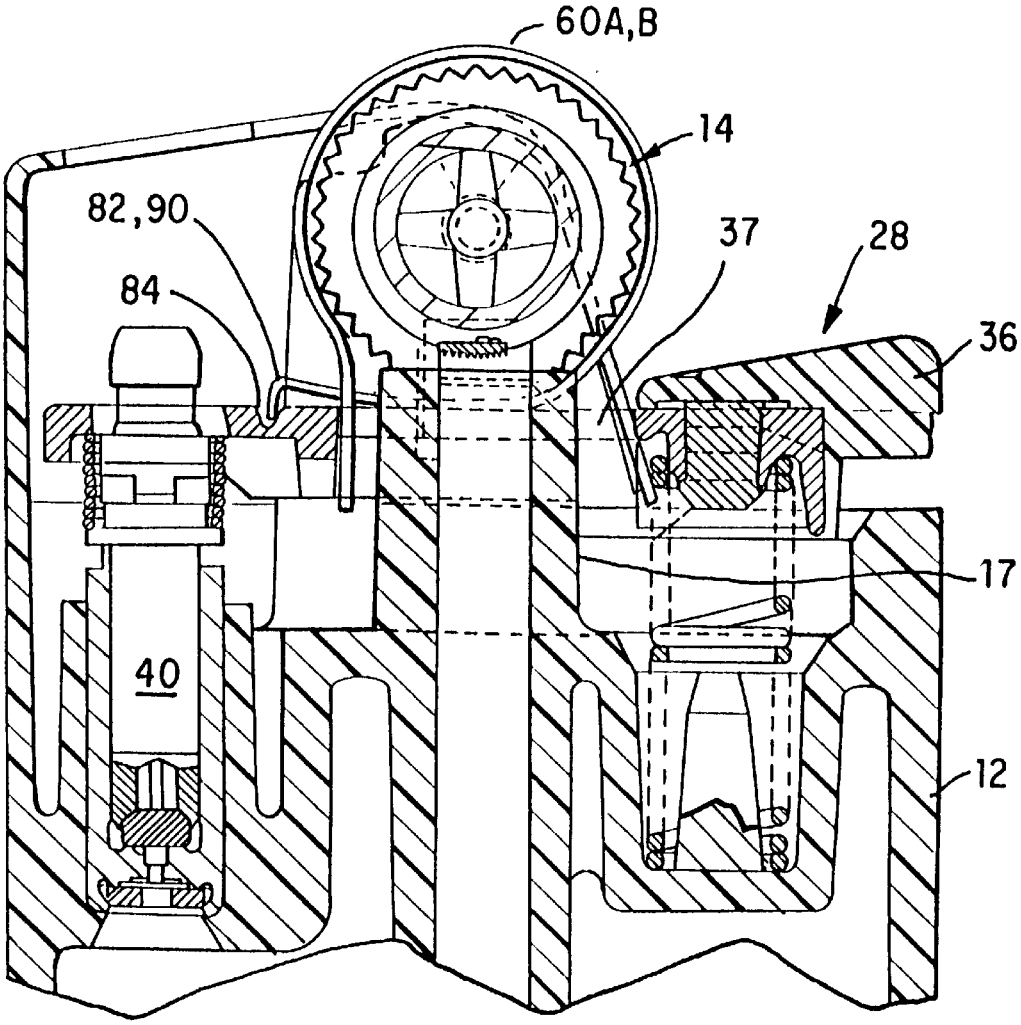
FIG. 14 is a partial cross-sectional side view of the lighter with the guard shown in FIG. 12 or FIG. 13.

FIG. 12 shows a guard 60A with first end 74 and second end 78 facing fuel valve 40. FIG. 14 illustrates a guard as in FIG. 12 disposed around striking wheel assembly 14. Two prongs 76 of first end 74 are disposed between striking wheel assembly 14 and fuel valve 40 and positioned such that the space between the two prongs allows sparks to pass to fuel valve 40. Guard 60A further comprises hole 80 which lies just before second end 78 and is disposed around boss 17. Second end 78 rests on or below valve actuator 28 wherein the second end terminates with a curved hook or lip 82. Valve actuator 28 defines a recessed pocket 84 wherein the curved hook or lip 82 rests in recessed pocket 84. First end 74 passes through opening 37 defined in valve actuator 28. In a further alternative embodiment of this design, second end 78 rests on a portion of the lighter body and lip 82 is received in a pocket in the lighter body.

Similarly, in another embodiment as shown in FIG. 13, first end 86 of guard 60B rests on valve actuator 28, wherein each prong 88 of first end 86 terminates with a curved hook or lip 90. FIG. 14 also illustrates a guard as in FIG. 13 disposed around striking wheel assembly 14. (Guards 60A and 60B appear similar in side view). As shown in FIG. 14, curved hook or lip 90 rests in one or more recessed pockets 84 of valve actuator 28. The one or more recessed pockets also accommodate first end 86. Guard 60B further comprises opening 92 which may be an extension of the predetermined distance between two prongs 88 of first end 86. Second end 93 preferably has a predetermined width, at least in a region where spark passes, such that sparks can pass therearound to ignite fuel escaping from the valve. Alternatively, second end 93 may provide a spark orifice such that sparks can pass therethrough. Second end 93 passes through opening 37 defined in valve actuator 28.

Figure 16:
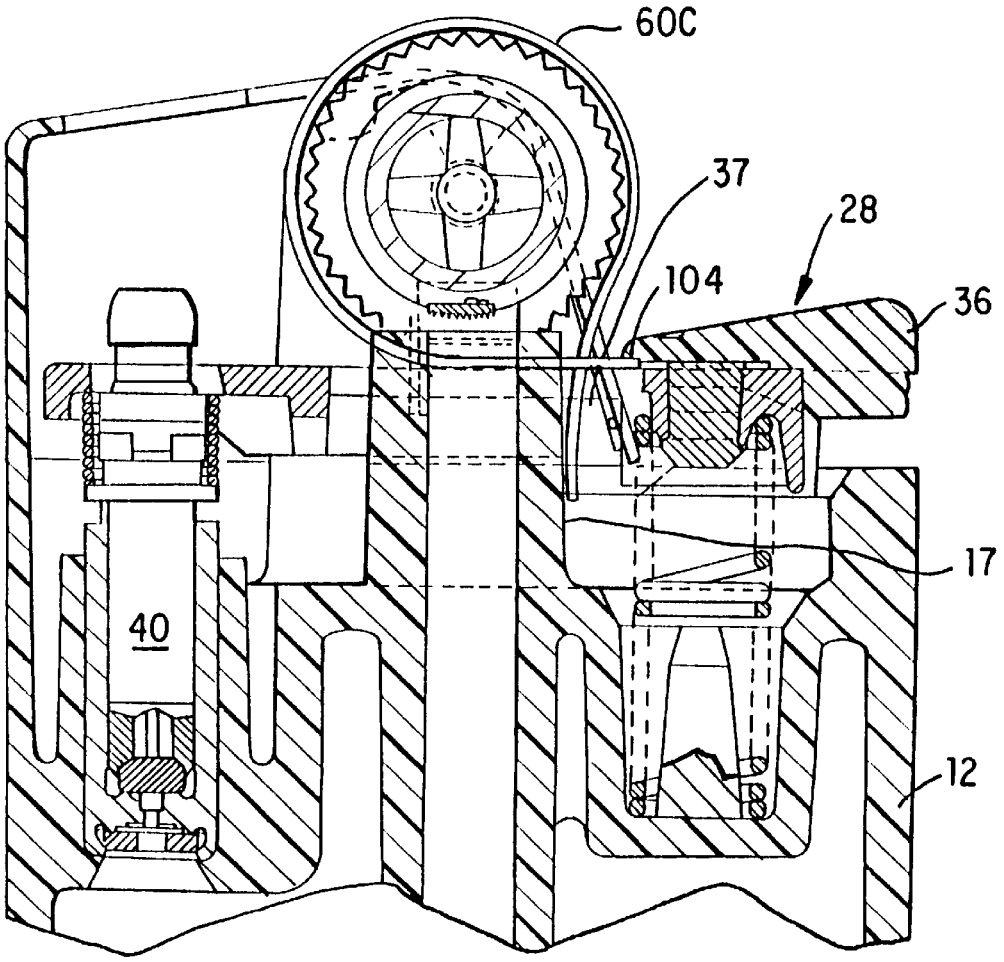
FIG. 16 is a partial cross-sectional side view of the lighter with the guard shown in FIG. 15.

Referring now to FIG. 15, first end 94 and second end 98 of guard 60C may alternatively face thumb pad 36. FIG. 16 shows guard 60C of FIG. 15 disposed around striking wheel assembly 14. Guard 60C comprises spark orifice 100 disposed between striking wheel assembly 14 and fuel valve 40. Second end 98 passes through opening 37 defined in valve actuator 28 and first end 94 rests on valve actuator 28. First end 94 further comprises one or more tabs 102 disposed on one or both of two prongs 96 wherein each tab 102 engages a lip 104 disposed under thumb pad 36. Guard 60 further comprises opening 101 disposed around boss 17 wherein opening 101 may be an extension of a distance between prongs 96. When lighter 10 is in the inoperative position, engagement of tab 102 with lip 104 may act against depression of thumb pad 36. After guard 60C is depressed, tab 102 disengages lip 104 and thus valve actuator 28 is free to actuate fuel valve 40.

Figure 17:
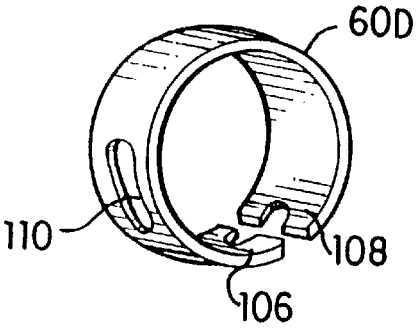
FIG. 17 is a perspective view of another embodiment of a guard of the present invention.
Figure 19:
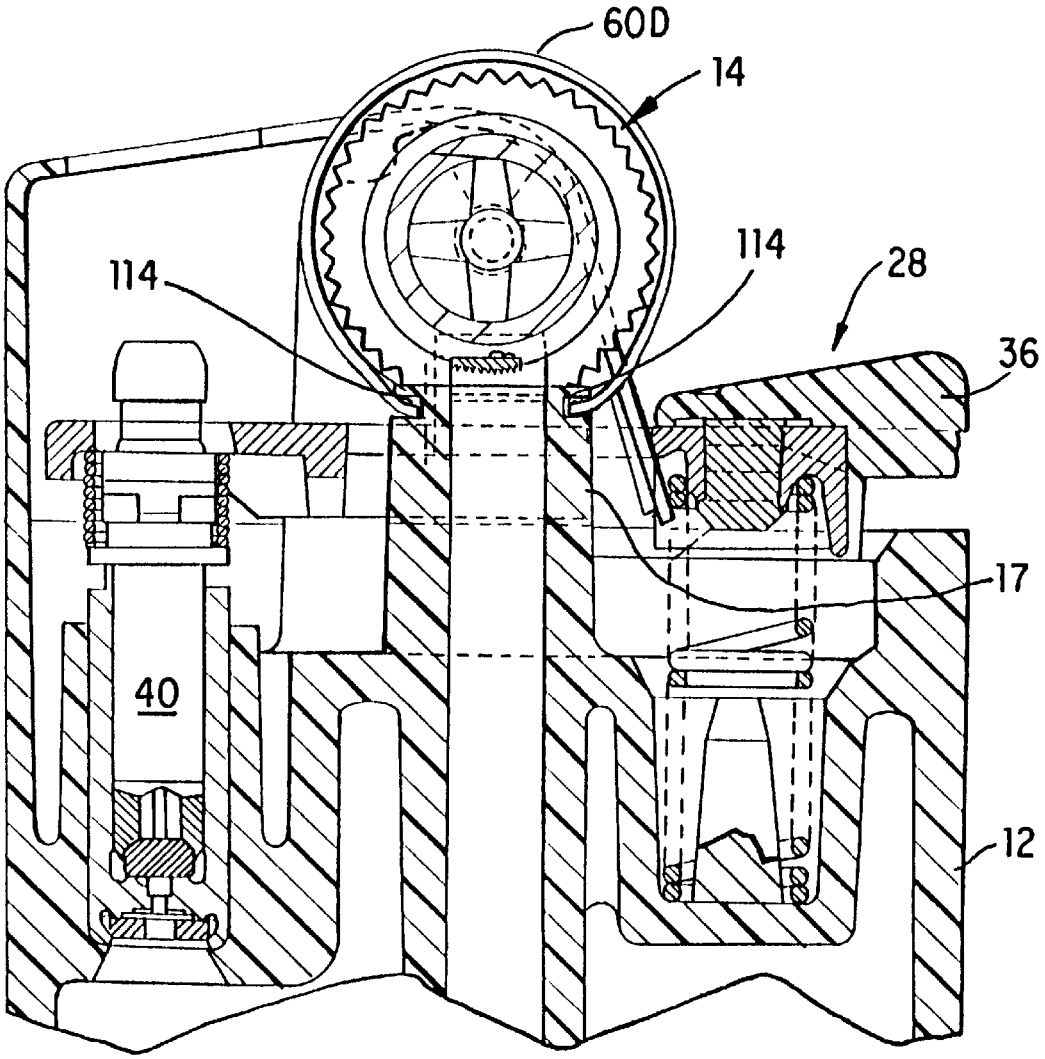
FIG. 19 is a partial cross-sectional side view of the lighter with the guard shown in FIG. 17 or FIG. 18.

In another embodiment of the guard of the present invention, the ends of the guard do not overlap. For example, FIGS. 17 and 18 show two different embodiments of guard 60D wherein first end 106 and second end 108 are disposed around boss 17, as shown in FIG. 19. Guard 60D further comprises spark orifice 110 disposed between striking wheel assembly 14 and valve actuator 40. First end 106 and second end 108 exert a spring compression force on each other and/or on boss 17, thereby resulting in a clamping force around boss 17. Boss 17 may also define one or more notches 114 to accommodate first end 106 and second end 108 of guard 60D. As shown in FIG. 18, guard 60D may further comprise one or more openings and/or slits 112 for increased flexibility of guard 60D.

Figure 20:
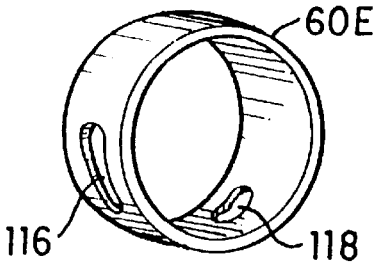
FIG. 20 is a perspective view of another embodiment of a guard of the present invention.
Figure 21:
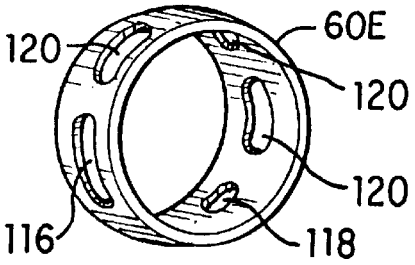
FIG. 21 is a perspective view of another embodiment of a guard of the present invention.
Figure 22:
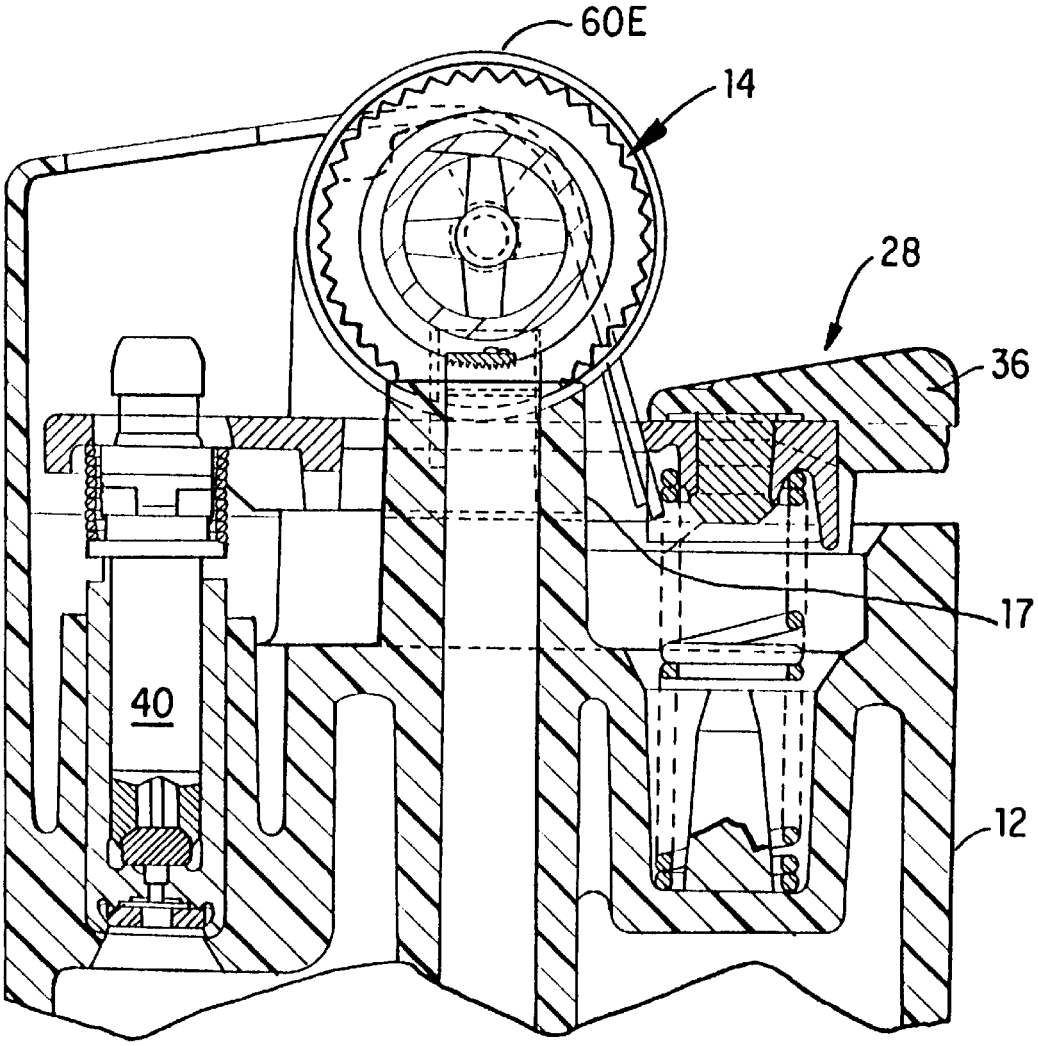
FIG. 22 is a partial cross-sectional side view of the lighter with the guard shown in FIG. 20 or FIG. 21.

The guard according to the present invention may also be formed as a continuous loop, such that the first and second ends are joined together. Examples of such a guard are shown in FIGS. 20 and 21. In FIG. 20, guard 60E comprises a spark orifice 116 disposed between striking wheel assembly 14 and fuel valve 40, as shown in FIG. 22. Guard 60E further comprises a hole 118 disposed around boss 17. FIG. 21 shows a similar guard 60E but further comprising one or more openings and/or slits 120 for increased flexibility of the guard.

Figure 23:
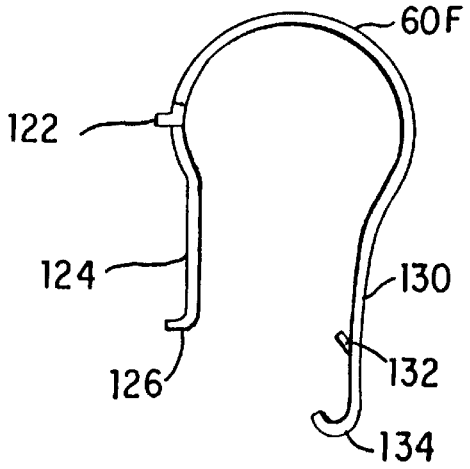
FIG. 23 is a side view of another embodiment of a guard of the present invention.
Figure 24:
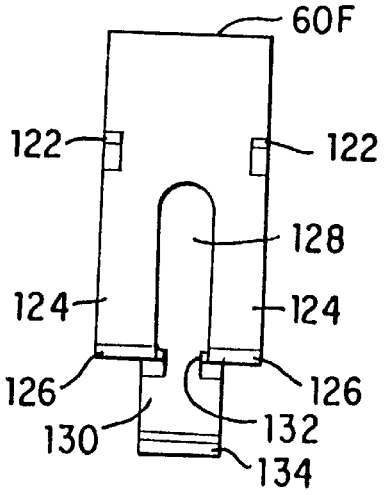
FIG. 24 is a front view of the guard shown in FIG. 23.
Figure 25:
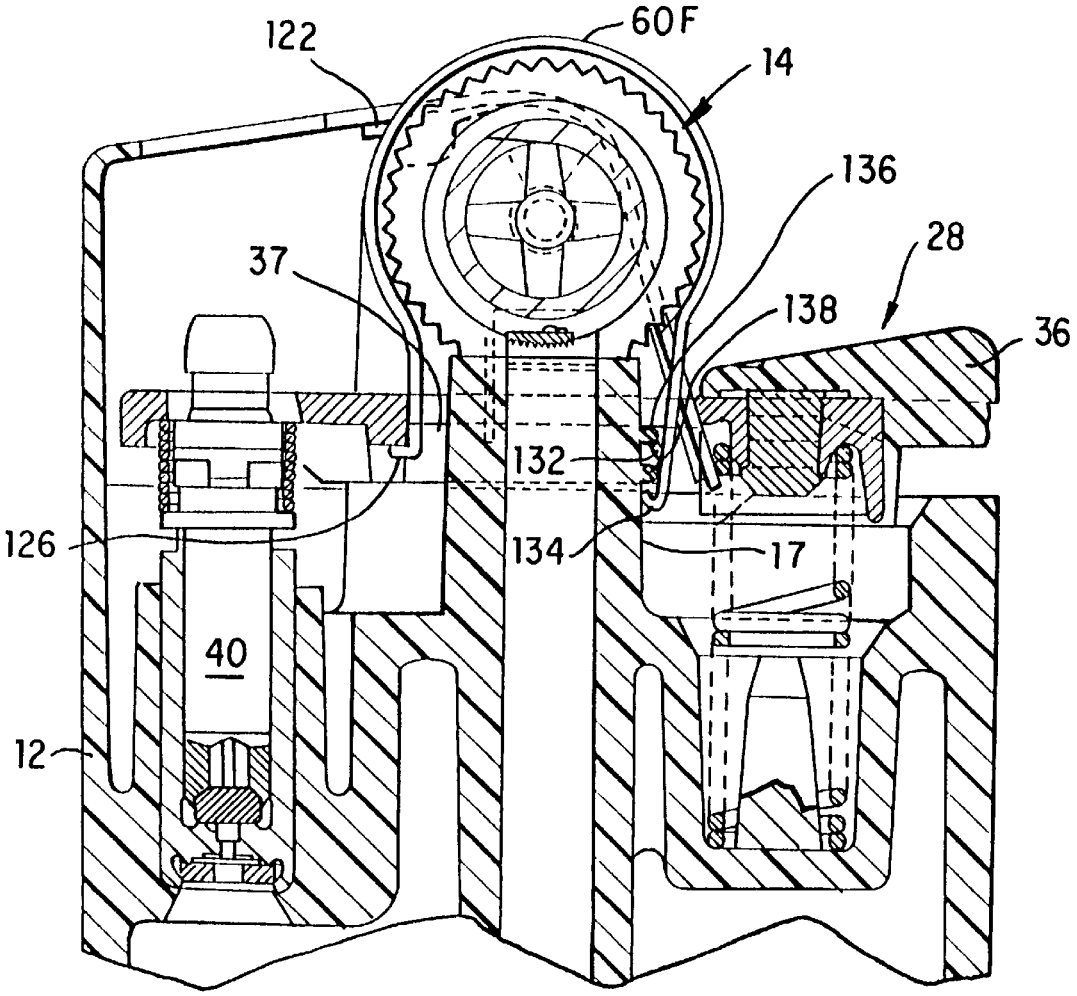
FIG. 25 is a partial cross-sectional side view of the lighter with the guard shown in FIGS. 23 and 24.

The guard of the present invention may alternatively be formed as a partial loop comprising various retaining means linked to shield 50, lighter body 12 and/or activator 28. An example of such an embodiment is shown in FIGS. 23 and 24, wherein FIG. 23 shows a side view of guard 60F and FIG. 24 shows a front view of guard 60F. Furthermore, FIG. 25 shows guard 60F of FIGS. 23 and 24 disposed at least partially around striking wheel assembly 14. This guard and the embodiments shown in FIGS. 26, 28, and 30 extend more than about 180° around the striking wheel assembly and preferably extend at least approximately 270° around the striking wheel assembly. This permits the guards to extend to or beyond the valve actuator on both sides of the spark wheel to provide retention means separate from the windshield.

Guard 60F comprises at least one first retaining member 122 which is fitted under shield 50. Retaining member 122 may be stamped from guard 60. Guard 60F further comprises a first end 124 disposed between fuel valve 40 and striking wheel assembly 14. First end 124 defines opening 128 wherein spark may pass therethrough. Opening 128 may be a slot as shown in FIG. 24. First end 124 extends down through cavity 37 of valve actuator 28 and terminates with at least one second retaining member 126 which further increases the retention of guard 60F by engaging under the valve actuator. Second end 130 of guard 60F extends down through cavity 37 and is disposed between thumb pad 36 and striking wheel assembly 14. Second end 130 comprises lock tab 132 and terminates with hook 134. As shown in FIG. 25, lock tab 132 and hook 134 may both be used to retain guard 60F with first boss 136 and second boss 138, respectively, defined on lighter body 12.

Figure 26:
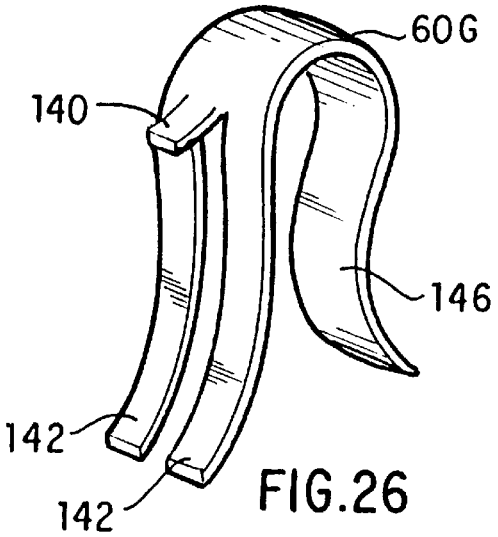
FIG. 26 is a perspective view of another embodiment of a guard of the present invention.
Figure 27:
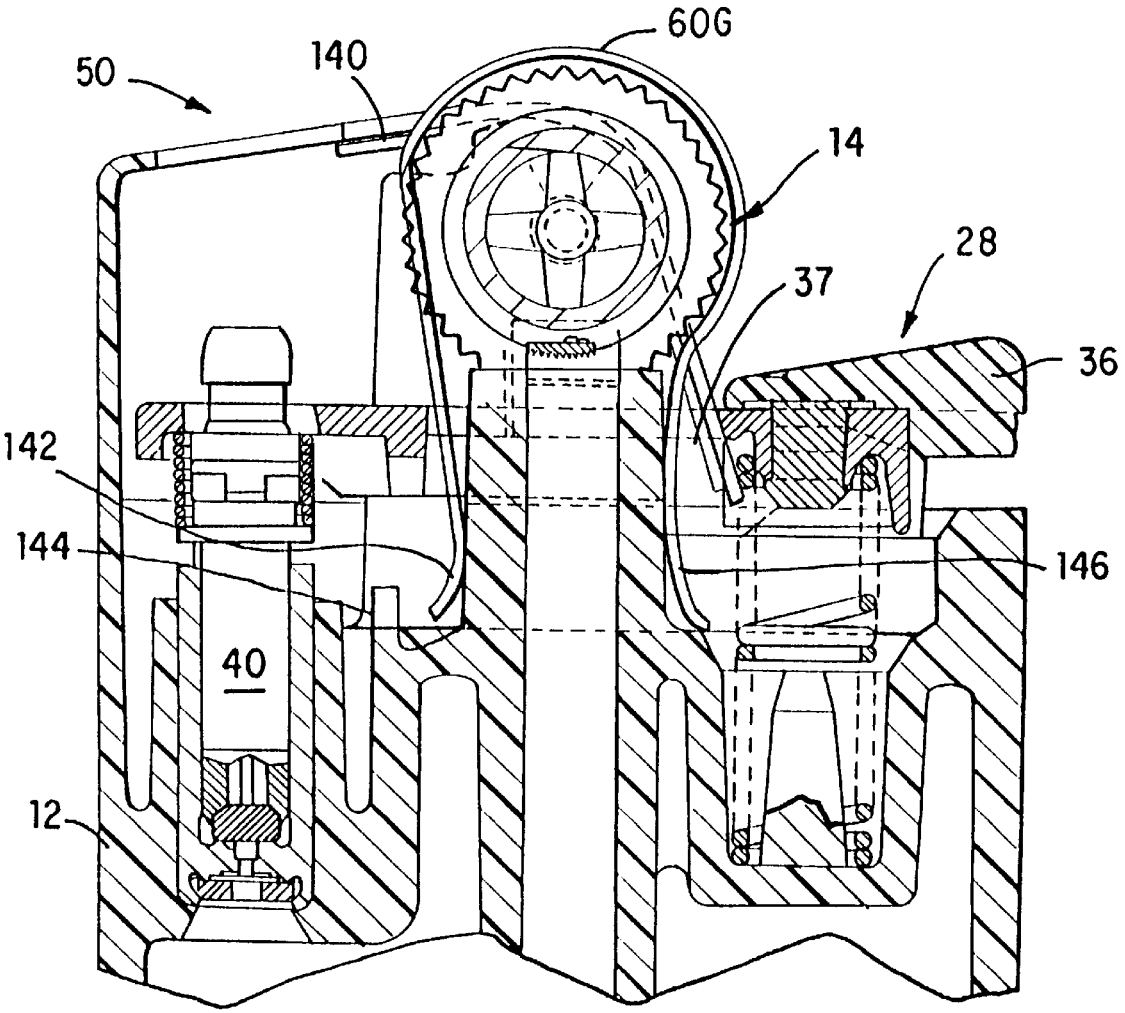
FIG. 27 is a partial cross-sectional side view of the lighter with the guard shown in FIG. 26.

FIG. 26 shows a perspective view of another embodiment of guard 60G of the present invention and FIG. 27 shows guard 60G of FIG. 26 disposed at least partially around striking wheel assembly 14. Guard 60G comprises at least one retaining member 140 disposed under windshield 50 thereby retaining guard 60G under shield 50 which is in turn mounted on lighter body 12 as is known in the art. Guard 60G further comprises one or more first supports 142 extending down through cavity 37 of valve actuator 28 wherein retaining member 140 is disposed therebetween and wherein supports 142 are disposed between striking wheel assembly 14 and valve 40. First supports 142 may further be disposed behind stopping member 144 defined by lighter body 12 as shown in FIG. 27, wherein stopping member 144 may limit depression of guard 60G. Guard 60G additionally comprises one or more second supports 146 extending down through cavity 37 of valve actuator 28 wherein the one or more second supports 146 are disposed between thumb pad 36 and striking wheel assembly 14. The one or more first supports 142 and the one or more second supports 146 may each terminate with a lip to increase retention of guard 60G.

Figure 28:
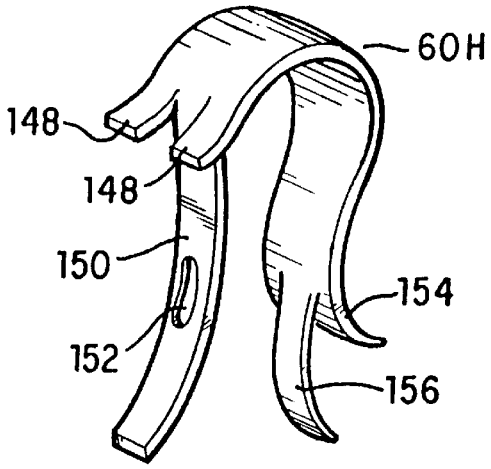
FIG. 28 is a perspective view of another embodiment of a guard of the present invention.
Figure 29:
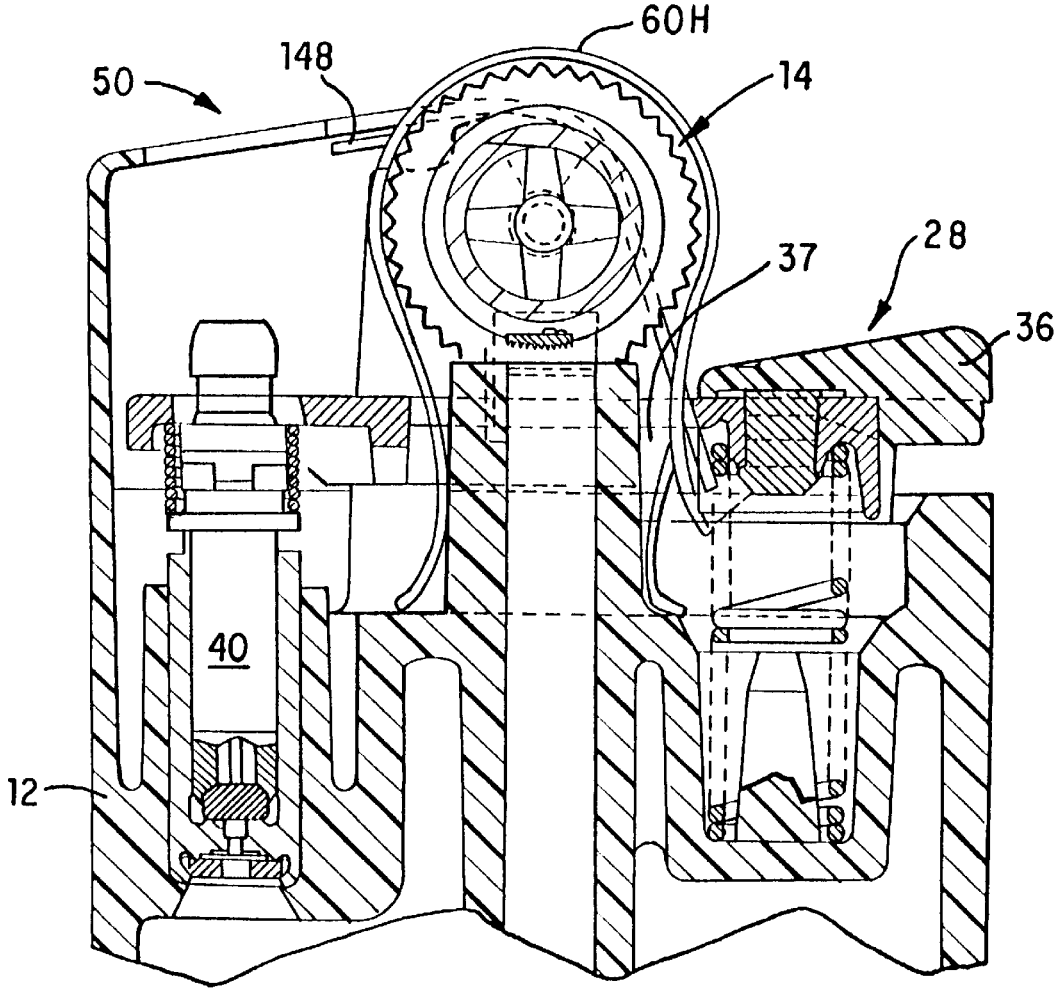
FIG. 29 is a partial cross-sectional side view of the lighter with the guard shown in FIG. 28.

In a similar alternative embodiment shown in FIG. 28, guard 60H comprises two or more retaining members 148 disposed under shield 50 thereby retaining guard 60H under shield 50 which is in turn mounted on lighter body 12. FIG. 29 shows guard 60H of FIG. 28 at least partially disposed around striking wheel assembly 14. Guard 60H further comprises one or more first supports 150 extending down through cavity 37 of valve actuator 28 and disposed between striking wheel assembly 14 and fuel valve 40, and further disposed between two or more retaining members 148. If guard 60H comprises more than one first support, first supports 150 may be disposed such that sparks may pass therebetween. Alternatively, width of one of the one or more first supports 150 may be disposed such that sparks may pass therethrough. Alternatively, width of first support 150 may be such that sparks may pass therearound. Yet another alternative is to have one of the one or more first supports 150 define a spark orifice 152 such that sparks may pass therethrough, as shown in FIG. 28. Guard 60H further comprises one or more second supports 154 which extend down through cavity 37 of valve actuator 28 wherein second supports 154 engage valve actuator 28 thereby further retaining guard 60H to the lighter. Guard 60 may further comprise one or more third supports 156 which extend down from second supports 154, wherein the one or more third supports 156 increases the retention of guard 60H.

Figure 31:
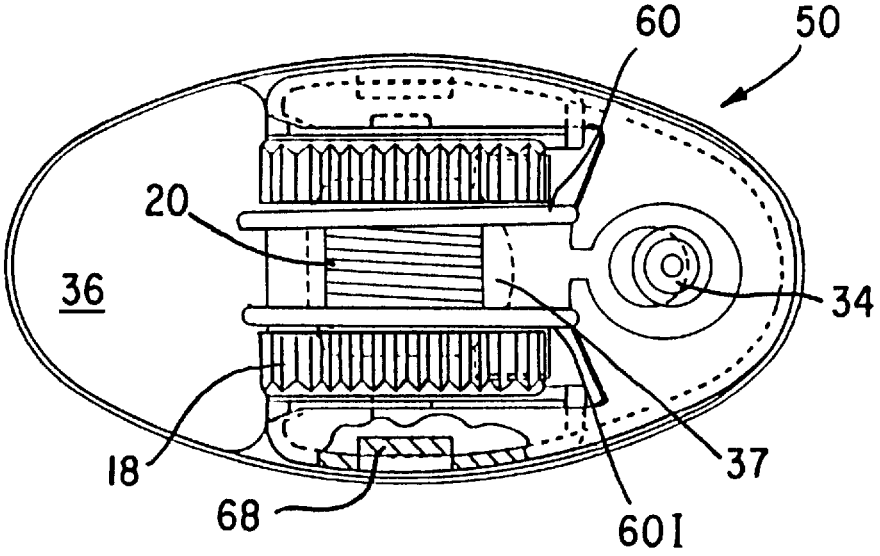
FIG. 31 is a partial top view of the lighter with the guard shown in FIG. 30.
Figure 30:
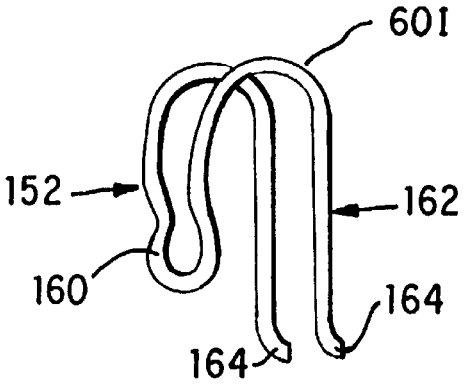
FIG. 30 is a perspective view of another embodiment of a guard of the present invention.
Figure 32:
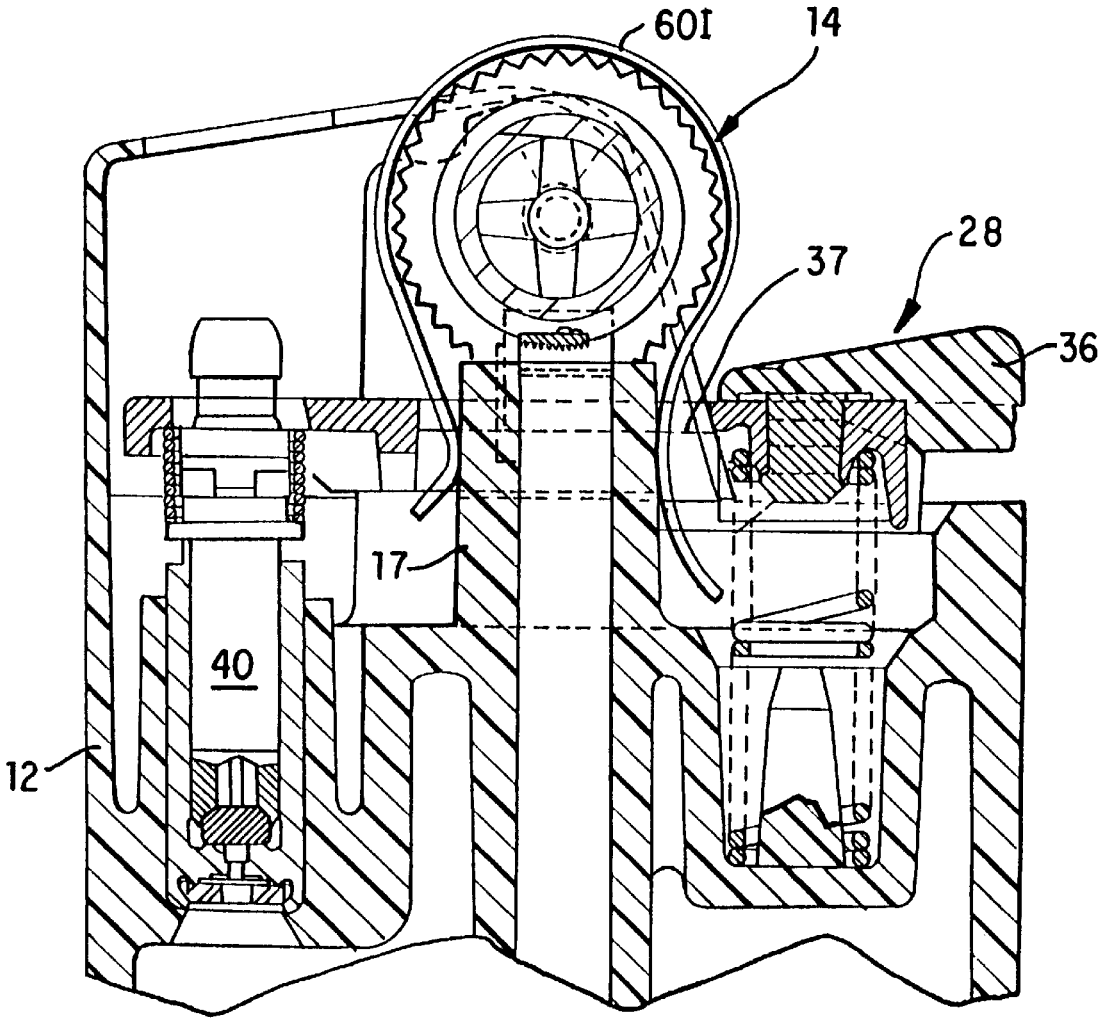
FIG. 32 is a partial cross-sectional side view of the lighter with the guard shown in FIGS. 30 and 31.

In another embodiment, guard 60I may be formed as a spring clip, an example of which is shown in FIG. 30. FIG. 31 shows guard 60I of FIG. 30 at least partially disposed around striking wheel assembly 14. Guard 60I comprises a first end 158 wherein the first end is looped and wherein the first end extends down through cavity 37 of valve actuator 28. Looped first end 158 terminates with a lip 160 thereby increasing the retention of guard 60I. Guard 60I further comprises second end 162 wherein the second end extends through cavity 37 of valve actuator 28 and is disposed between striking wheel assembly 14 and thumb pad 36. Second end 162 comprises two end tails 164, wherein each tail 164 terminates with a hook which further increases the retention of guard 60I. Spring force of guard 60I causes lip 160 of first end 158 as well as hooks of terminals 164 to exert clamping force upon boss 17 thereby retaining guard 60I on lighter body 12.

Each of the many embodiments of the guard described above may further comprise one or more first brake members 168 disposed on inside surface of guard 60, as shown in FIG. 2. In the rest position, as shown in FIG. 2, brake member 168 engages at least one turning wheel 18. In this position, the brake member resists rotation of spark wheel assembly 14 which could create a spark and produce a flame without manipulation of the guard member. When the guard member is depressed and deformed, brake member 168 is moved away and rotation of the spark wheel assembly is not resisted.

Additionally or alternatively in conjunction with each of the many embodiments of guard 60, valve actuator 28 may further comprise one or more second brake members 170 as shown in FIGS. 2, 5, 6, and 7 if the particular embodiment of guard 60 is such that clearance is provided between turning wheels 18 and the one or more second brake members. Each brake member 170 preferably has a generally angled surface with a plurality of teeth 172 on one side of the brake member. Teeth 172 are oriented toward turning wheels 18. The one or more second brake members 170 work in conjunction with one or more turning wheels 18 to stop the rotation of the striking wheel assembly. Other configurations, such as a curved surface opposing the turning wheels with a material to grip or to otherwise engage the turning wheels or other parts of the striking wheel assembly, or a squared off member with an edge that catches on a turning wheel may be used. After the valve actuator 28 is depressed and moved into its operative position, second brake members 170 move toward striking wheel assembly 14 and engage turning wheels 18 in such a way that teeth 172 mesh with the teeth 49 on the turning wheels and arrest any further rotation of striking wheel assembly 14.

A person of ordinary skill in the art may select a suitable configuration for first brake members 168 and/or second brake members 170 for stopping the rotation of the striking wheel assembly based on the teachings of the present invention.

While various descriptions of the present invention were described above, it is understood that the various features of the present invention can be used singly or in any combination thereof. Therefore, this invention is not to be limited to only the specifically preferred embodiments depicted therein.

What is claimed is:

1. A lighter comprising:

a lighter body containing a fuel reservoir with a valve for releasing fuel therefrom;

spark producing element rotatable by a user to produce sparks directed toward said valve, said element mounted on the body with at least a portion thereof exposed for manipulation and rotation by the user;

a valve actuator depressible to actuate said valve and release said fuel; and a guard member having first and second ends mounted on the lighter and forming a loop around said spark producing element with said first and second ends being both secured to at least one of the lighter body and valve actuator, wherein said guard member is normally disposed radially outward from at least a portion of said exposed portion of said spark producing element so as to inhibit manipulation of the spark producing element and is depressible to a position permitting manipulation of said spark producing element.

2. The lighter as set forth in claim 1 wherein the guard member extends more than about 180° around the spark producing element.

3. The lighter as set forth in claim 2 wherein at least a portion of said guard first end overlaps at least a portion of said second end to form a closed loop guard.

4. The lighter as set forth in claim 3, wherein:

the lighter body includes a upstanding member disposed under the spark producing element; and the guard member first and second ends each define an opening through which said upstanding member is received to retain said guard member in place.

5. The lighter as set forth in claim 4, wherein said openings define closed shapes which surround said upstanding member.

6. The lighter as set forth in claim 4, wherein said openings define open, C-like shapes.

7. The lighter as set forth in claim 2 wherein one said end defines two spaced apart prongs and the other end is disposed between said prongs.

8. The lighter as set forth in claim 2 wherein said first end rests on the valve actuator and terminates within a recess defined in the valve actuator and said second end is inserted through a hole defined in the valve actuator and received in a hole defined in the lighter body.

9. The lighter as set forth in claim 2 wherein said first end comprises one or more tabs which engage one or more lips defined in said valve actuator and wherein said second end is inserted through a hole defined in said valve actuator and received in a hole in the lighter body.

10. The lighter as set forth in claim 2 wherein the guard member further defines a flash aperture positioned on said member such that the flash aperture is adjacent to the valve allowing sparks to pass therethrough to reach the valve.

11. The lighter as set forth in claim 1 wherein said guard further comprises one or more brakes disposed radially inward on said guard to prevent rotation of said spark producing element.

12. The lighter as set forth in claim 11, wherein said brake comprises a finger-like element extending inward from the guard member to engage the spark producing element such that rotation of the spark producing element is resisted absent deformation of the guard member by a user.

13. The lighter as set forth in claim 1 wherein said valve actuator comprises one or more second brake means to prevent rotation of said spark producing element after depression of said valve actuator.

14. The lighter according to claim 13, wherein:

said valve actuator further comprises a pivoting lever pivotable about a point disposed under said spark producing element with a first end depressible by a user and a second end raisable in response thereto to actuate said valve; and said second brake member comprises at least one upstanding member disposed on said pivotable lever between said second end and the pivot point such that depression of the first end causes the second brake member to engage the spark producing element.

15. The lighter as set forth in claim 14 wherein the guard member has a U-shape and the first and second ends are biased against the lighter body to maintain the guard member in position.

16. The lighter as set forth in claim 1, wherein said first end and second end extend through an opening defined in the valve actuator.

17. The lighter according to claim 16, wherein said guard member comprises at least one hook formed on at least one of said ends of the guard member, said at least one hook engaged behind at least one of the valve actuator and a portion of the lighter body.

18. A lighter comprising:

a body having a fuel reservoir and defining a central cylindrical cavity;

a striking wheel assembly rotatably mounted on the body at a top end, wherein the striking wheel assembly comprises a rotary sparker and at least one turning wheel mounted coaxially with the rotary sparker;

a flint disposed within the cylindrical cavity and in frictional contact with the rotary sparker, wherein rotation of the rotary sparker against the flint creates sparks;

a valve for releasing fuel from the fuel reservoir to outside the body of the lighter, wherein the valve has an open position and a closed position valve;

a valve actuator pivotally attached to the body, wherein the actuator controls movement of the valve between the open position and closed position; and a guard member extending at least from the valve actuator over the rotary sparker and back to the valve actuator wherein at least a portion of said guard member is elevated above the at least one turning wheel such that manipulation of said element is prevented until application of a predetermined force sufficient to elastically deform said guard member to a position permitting manipulation of the at least one turning wheel.

19. The lighter as set forth in claim 18, further comprising at least one brake member mounted on the valve actuator, wherein after the valve actuator is depressed and the valve is moved toward the open position, the at least one brake member engages the striking wheel assembly to arrest the rotation of the striking wheel assembly.

20. The lighter as set forth in claim 19, wherein said brake member comprises a gripping member adapted to engage the striking wheel assembly.

21. The lighter as set forth in claim 18, wherein the guard member comprises one or more retention elements to enhance retention of the guard on the body of the lighter.

22. The lighter as set forth in claim 18 wherein the guard member further defines a flash aperture positioned on said member such that the flash aperture is adjacent to the valve allowing sparks to pass therethrough to reach the valve.

* * * * *